US007835534B2

(12) United States Patent
Cole, Jr. et al.

(10) Patent No.: US 7,835,534 B2
(45) Date of Patent: Nov. 16, 2010

(54) BATTERY CHARGING JOBSITE LUNCHBOX

(75) Inventors: Steven W. Cole, Jr., Lombard, IL (US); Richard E. Gray, Chicago, IL (US)

(73) Assignee: Robert Bosch GmbH, Stuttgart (DE)

( * ) Notice: Subject to any disclaimer, the term of this patent is extended or adjusted under 35 U.S.C. 154(b) by 6 days.

(21) Appl. No.: 11/488,330

(22) Filed: Jul. 18, 2006

(65) Prior Publication Data

US 2007/0024237 A1 Feb. 1, 2007

Related U.S. Application Data

(63) Continuation-in-part of application No. 10/685,280, filed on Oct. 14, 2003, and a continuation-in-part of application No. 11/055,341, filed on Feb. 10, 2005.

(60) Provisional application No. 60/700,152, filed on Jul. 18, 2005.

(51) Int. Cl.
*H04R 29/00* (2006.01)

(52) U.S. Cl. ..... 381/189; 381/334; 320/107; 320/112; 320/113; 219/717

(58) Field of Classification Search ..... 381/124, 381/334, 189, 336; 219/702, 387, 717; 320/107, 320/112–113
See application file for complete search history.

(56) References Cited

U.S. PATENT DOCUMENTS

| | | | |
|---|---|---|---|
| 1,511,581 | A | 10/1924 | Ritter et al. |
| 1,518,508 | A | 12/1924 | Hartwig |
| D134,136 | S | 10/1942 | Sherman et al. |
| D134,818 | S | 1/1943 | Fletcher |
| 2,473,194 | A | 6/1949 | Chou |
| D163,645 | S | 6/1951 | Shuler et al. |
| 2,565,273 | A | 8/1951 | Shuler et al. |
| 2,582,330 | A | 1/1952 | Hautala |
| 2,591,438 | A | 4/1952 | Kinman et al. |
| 2,771,559 | A | 11/1956 | Montmeat |

(Continued)

FOREIGN PATENT DOCUMENTS

| | | |
|---|---|---|
| DE | 1136764 | 9/1962 |

(Continued)

OTHER PUBLICATIONS

Carl J. Campagnuolo et al., Development of the G-76/G direct current generator for charging batteries and powering radios, p. 238-243.

(Continued)

*Primary Examiner*—Devona E. Faulk
*Assistant Examiner*—Disler Paul
(74) *Attorney, Agent, or Firm*—Greer, Burns & Crain, Ltd.

(57) ABSTRACT

A preferred embodiment of portable lunchbox equipment that is particularly useful at construction and other jobsites is disclosed which provides important desirable features and functionality comprising a housing, at least one charger for charging a removable battery pack, an audio unit for producing an audio signal, a heating unit, an insulated compartment, a cooling unit for the compartment, a cord and plug for connecting said apparatus to a source of AC power, and circuitry for selectively applying power to the audio unit, the charger and the heating unit.

15 Claims, 9 Drawing Sheets

U.S. PATENT DOCUMENTS

| | | | | |
|---|---|---|---|---|
| 2,771,560 | A | | 11/1956 | Creiman |
| 3,079,510 | A | | 2/1963 | Hartwig |
| 3,214,670 | A | | 10/1965 | Schaf |
| 3,267,510 | A | | 8/1966 | Cote |
| 3,458,794 | A | | 7/1969 | Bohnstedt et al. |
| 3,521,142 | A | | 7/1970 | Ludlam |
| 3,525,912 | A | | 8/1970 | Wallin |
| 3,533,119 | A | | 10/1970 | Dokos |
| 3,824,472 | A | | 7/1974 | Engel et al. |
| 3,852,652 | A | | 12/1974 | Jasinski |
| 3,883,789 | A | | 5/1975 | Achenbach et al. |
| 3,943,423 | A | | 3/1976 | Hoffman |
| 3,962,591 | A | | 6/1976 | Popka |
| 3,968,417 | A | | 7/1976 | Dials |
| 3,971,889 | A | | 7/1976 | Hays |
| D240,836 | S | | 8/1976 | Corvette |
| 3,984,645 | A | | 10/1976 | Kresch |
| 4,006,764 | A | | 2/1977 | Yamamoto et al. |
| 4,045,663 | A | | 8/1977 | Young |
| 4,050,493 | A | | 9/1977 | Cho |
| 4,091,318 | A | | 5/1978 | Eichler et al. |
| 4,095,184 | A | | 6/1978 | Hochstein et al. |
| 4,188,585 | A | | 2/1980 | Wissel et al. |
| 4,194,157 | A | | 3/1980 | Uno |
| 4,489,268 | A | | 12/1984 | Beachy |
| 4,628,242 | A | | 12/1986 | Scholefield |
| 4,645,996 | A | | 2/1987 | Toops |
| D296,243 | S | | 6/1988 | Ohashi |
| 4,751,452 | A | | 6/1988 | Kilmer et al. |
| 4,835,409 | A | * | 5/1989 | Bhagwat et al. ..... 307/64 |
| 4,870,702 | A | | 9/1989 | Azzouni |
| 4,904,837 | A | * | 2/1990 | Low et al. ..... 219/717 |
| D307,829 | S | | 5/1990 | Hasuike |
| 4,933,988 | A | | 6/1990 | Thibault |
| D310,529 | S | | 9/1990 | Yuen |
| 4,993,061 | A | | 2/1991 | Hsieh |
| D320,210 | S | | 9/1991 | Mbuthia |
| D320,600 | S | | 10/1991 | Yuen |
| 5,055,986 | A | | 10/1991 | Johnson |
| D321,513 | S | | 11/1991 | Totsuka et al. |
| D327,468 | S | | 6/1992 | Dea et al. |
| 5,118,962 | A | | 6/1992 | Ishii et al. |
| 5,136,229 | A | | 8/1992 | Galvin |
| 5,146,618 | A | | 9/1992 | Wenner |
| 5,150,031 | A | | 9/1992 | James et al. |
| 5,170,851 | A | | 12/1992 | Kress et al. |
| 5,172,043 | A | | 12/1992 | Toops |
| D332,768 | S | | 1/1993 | Giard, Jr. |
| 5,179,747 | A | | 1/1993 | Zink |
| 5,187,422 | A | | 2/1993 | Izenbaard et al. |
| 5,191,277 | A | | 3/1993 | Ishikura et al. |
| 5,193,220 | A | | 3/1993 | Ichinohe et al. |
| 5,218,284 | A | | 6/1993 | Burns et al. |
| 5,220,269 | A | | 6/1993 | Chen et al. |
| 5,235,822 | A | * | 8/1993 | Leonovich, Jr. ..... 62/457.2 |
| 5,239,687 | A | | 8/1993 | Chen |
| 5,245,269 | A | | 9/1993 | Tooley et al. |
| 5,254,927 | A | | 10/1993 | Chiang |
| 5,254,931 | A | | 10/1993 | Martensson |
| 5,256,953 | A | | 10/1993 | Cimbal et al. |
| 5,262,710 | A | | 11/1993 | Taylor |
| 5,283,654 | A | | 2/1994 | Cho |
| 5,300,875 | A | | 4/1994 | Tuttle |
| 5,317,249 | A | | 5/1994 | Ford |
| 5,319,937 | A | * | 6/1994 | Fritsch et al. ..... 62/3.62 |
| 5,325,040 | A | | 6/1994 | Bogut et al. |
| D348,461 | S | | 7/1994 | Peersmann |
| D349,116 | S | | 7/1994 | Peersmann |
| 5,339,956 | A | | 8/1994 | Thomason |
| 5,343,136 | A | | 8/1994 | Yamaguchi et al. |
| 5,344,339 | A | | 9/1994 | Cheslock |
| 5,369,565 | A | | 11/1994 | Chen et al. |
| 5,369,797 | A | | 11/1994 | Tyree |
| 5,371,784 | A | | 12/1994 | Yankura |
| 5,394,073 | A | | 2/1995 | Nagai |
| 5,396,162 | A | | 3/1995 | Brilmyer |
| 5,404,419 | A | | 4/1995 | Artis, Jr. |
| D358,579 | S | | 5/1995 | Richards et al. |
| 5,434,018 | A | | 7/1995 | Sasaki et al. |
| 5,437,938 | A | | 8/1995 | Mitsui et al. |
| 5,447,041 | A | | 9/1995 | Piechota |
| 5,459,388 | A | | 10/1995 | Illingworth et al. |
| 5,460,906 | A | | 10/1995 | Leon et al. |
| 5,465,117 | A | | 11/1995 | Ide et al. |
| 5,471,128 | A | | 11/1995 | Patino et al. |
| 5,508,123 | A | | 4/1996 | Fan |
| 5,508,126 | A | | 4/1996 | Braun |
| 5,510,206 | A | | 4/1996 | Akami |
| 5,510,693 | A | | 4/1996 | Theobald |
| 5,552,692 | A | | 9/1996 | McKillop |
| 5,568,198 | A | | 10/1996 | Sakurai et al. |
| 5,572,592 | A | | 11/1996 | Muckelrath |
| 5,578,875 | A | | 11/1996 | Dormer et al. |
| 5,584,055 | A | | 12/1996 | Murui et al. |
| 5,587,250 | A | | 12/1996 | Thomas et al. |
| 5,590,401 | A | | 12/1996 | Ide et al. |
| 5,590,419 | A | | 12/1996 | Shimo |
| 5,606,241 | A | | 2/1997 | Patino et al. |
| 5,625,237 | A | | 4/1997 | Saeki et al. |
| 5,628,054 | A | | 5/1997 | Osaka |
| 5,633,096 | A | | 5/1997 | Hattori |
| 5,638,540 | A | | 6/1997 | Aldous |
| 5,650,669 | A | | 7/1997 | Aldous |
| 5,651,485 | A | | 7/1997 | Impastato |
| 5,656,917 | A | | 8/1997 | Theobald |
| 5,657,210 | A | | 8/1997 | Yamanaka |
| 5,665,485 | A | | 9/1997 | Kuwayama et al. |
| 5,672,441 | A | | 9/1997 | Aoki et al. |
| 5,680,026 | A | | 10/1997 | Lueschen |
| 5,685,421 | A | | 11/1997 | Gilmore |
| 5,689,171 | A | | 11/1997 | Ludewig |
| 5,694,467 | A | | 12/1997 | Young |
| D388,785 | S | | 1/1998 | Yuen |
| 5,717,314 | A | | 2/1998 | Wakefield |
| 5,752,205 | A | | 5/1998 | Dzung et al. |
| 5,764,029 | A | | 6/1998 | Coyle |
| 5,764,030 | A | | 6/1998 | Gaza |
| 5,771,471 | A | | 6/1998 | Alberth, Jr. et al. |
| 5,781,853 | A | * | 7/1998 | Johnson ..... 455/351 |
| 5,792,573 | A | | 8/1998 | Pitzen et al. |
| 5,793,130 | A | | 8/1998 | Anderson |
| 5,810,168 | A | | 9/1998 | Eggering |
| 5,814,968 | A | | 9/1998 | Lovegreen et al. |
| 5,834,921 | A | | 11/1998 | Mercke et al. |
| 5,847,541 | A | | 12/1998 | Hahn |
| 5,847,545 | A | | 12/1998 | Chen et al. |
| 5,870,149 | A | | 2/1999 | Comroe et al. |
| 5,889,383 | A | | 3/1999 | Teich |
| 5,949,216 | A | | 9/1999 | Miller |
| 5,977,175 | A | * | 11/1999 | Lin ..... 514/558 |
| 5,979,175 | A | * | 11/1999 | Ellison ..... 62/457.7 |
| 5,998,966 | A | | 12/1999 | Gaza |
| 6,002,237 | A | | 12/1999 | Gaza |
| 6,007,940 | A | | 12/1999 | Spotnitz |
| 6,025,694 | A | | 2/2000 | Mercke et al. |
| 6,051,334 | A | | 4/2000 | Tsurumaru et al. |
| 6,057,608 | A | | 5/2000 | Bailey, Jr. et al. |
| 6,058,320 | A | | 5/2000 | Yokota |
| 6,071,639 | A | | 6/2000 | Bryant et al. |
| 6,087,815 | A | | 7/2000 | Pfeifer et al. |
| 6,091,225 | A | | 7/2000 | Kim et al. |
| 6,112,414 | A | | 9/2000 | Andis et al. |
| 6,124,699 | A | | 9/2000 | Suzuki et al. |
| 6,127,797 | A | | 10/2000 | Walker |

| | | | | |
|---|---|---|---|---|
| 6,154,004 | A | 11/2000 | Higuchi | |
| 6,154,008 | A | 11/2000 | Bradus et al. | |
| 6,215,276 | B1 | 4/2001 | Smith | |
| 6,223,025 | B1 | 4/2001 | Tsukuda | |
| 6,223,835 | B1 | 5/2001 | Habedank et al. | |
| 6,230,029 | B1 | 5/2001 | Hahn et al. | |
| 6,233,343 | B1 | 5/2001 | Muranami et al. | |
| D444,451 | S | 7/2001 | Bailey | |
| 6,298,245 | B1 | 10/2001 | Usui et al. | |
| 6,305,185 | B1 * | 10/2001 | Sloan | 62/457.7 |
| 6,305,547 | B1 * | 10/2001 | Curran | 206/542 |
| 6,308,059 | B1 | 10/2001 | Domes | |
| 6,326,764 | B1 | 12/2001 | Virtudes | |
| 6,336,039 | B1 | 1/2002 | Usui et al. | |
| 6,374,127 | B1 | 4/2002 | Park | |
| 6,412,572 | B2 | 7/2002 | Habedank et al. | |
| 6,427,070 | B1 | 7/2002 | Smith | |
| 6,496,688 | B2 | 12/2002 | Smith | |
| 6,525,511 | B2 | 2/2003 | Kubale et al. | |
| 6,571,568 | B1 * | 6/2003 | Link | 62/244 |
| 6,621,246 | B2 | 9/2003 | Kubale et al. | |
| 6,788,026 | B2 * | 9/2004 | Muramatsu | 320/107 |
| 6,814,383 | B2 * | 11/2004 | Reed et al. | 296/24.3 |
| 6,927,373 | B2 * | 8/2005 | Jeon | 219/702 |
| 2001/0040798 | A1 | 11/2001 | Appelberg et al. | |
| 2002/0042258 | A1 | 4/2002 | Domes | |
| 2002/0077073 | A1 | 6/2002 | Smith | |
| 2002/0089306 | A1 | 7/2002 | Kubale et al. | |
| 2002/0113573 | A1 | 8/2002 | Woodroffe et al. | |
| 2002/0125857 | A1 | 9/2002 | Mastaler et al. | |
| 2002/0158604 | A1 * | 10/2002 | Smith | 320/107 |
| 2002/0171391 | A1 * | 11/2002 | Batts-Gowins | 320/103 |
| 2003/0040296 | A1 | 2/2003 | Smith | |
| 2003/0069001 | A1 | 4/2003 | Domes | |
| 2003/0071598 | A1 | 4/2003 | Kubale et al. | |
| 2003/0090239 | A1 | 5/2003 | Sakakibara | |
| 2003/0117107 | A1 | 6/2003 | Zick et al. | |
| 2004/0070369 | A1 | 4/2004 | Sakakibara | |
| 2004/0088817 | A1 * | 5/2004 | Cochran et al. | 15/327.5 |
| 2004/0095094 | A1 | 5/2004 | Kubale et al. | |
| 2004/0147295 | A1 | 7/2004 | Domes | |
| 2004/0155627 | A1 | 8/2004 | Stanesti et al. | |
| 2004/0160212 | A1 | 8/2004 | Mastaler et al. | |
| 2004/0239287 | A1 | 12/2004 | Batts-Gowins | |

FOREIGN PATENT DOCUMENTS

| | | | |
|---|---|---|---|
| DE | 1171524 | | 6/1964 |
| DE | 1463443 | | 1/1969 |
| DE | 2036476 | | 1/1972 |
| DE | G5342534 | | 3/1974 |
| DE | 3016551 | A1 | 12/1980 |
| DE | 4106557 | A1 | 9/1992 |
| DE | 69803432 | T2 | 6/1999 |
| EP | 0090480 | A2 | 10/1983 |
| EP | 0310717 | A1 | 4/1989 |
| EP | 0340794 | A2 | 11/1989 |
| EP | 0509284 | A2 | 10/1992 |
| EP | 0511740 | A1 | 11/1992 |
| EP | 0920062 | A1 | 6/1999 |
| EP | 0 987 783 | | 3/2000 |
| EP | 1311012 | A2 | 5/2003 |
| GB | 632185 | | 3/1950 |
| GB | 2195841 | A | 4/1988 |
| GB | 2239567 | A | 7/1991 |
| GB | 2242083 | A | 9/1991 |
| JP | 52-112705 | | 2/1951 |
| JP | 40-007852 | | 4/1962 |
| JP | 50-133804 | | 11/1975 |
| JP | 52-112705 | | 8/1977 |
| JP | 52-150005 | | 12/1977 |
| JP | 61-197646 | | 9/1986 |
| JP | 62-178632 | | 11/1987 |
| JP | 02-063587 | | 5/1990 |
| JP | 02-084490 | | 6/1990 |
| JP | 04-150728 | | 5/1992 |
| JP | 05-031378 | | 4/1993 |
| JP | 06-005232 | | 1/1994 |
| JP | 06-268548 | | 9/1994 |
| JP | 07-193444 | | 7/1995 |
| JP | 07-307580 | | 11/1995 |
| JP | 08-185893 | | 7/1996 |
| JP | 08-195191 | | 7/1996 |
| JP | 08-308113 | | 11/1996 |
| JP | 09-004715 | | 1/1997 |
| JP | 09-051281 | | 2/1997 |
| JP | 09-200974 | | 7/1997 |
| WO | WO 81/00654 | | 3/1981 |
| WO | WO 87/02848 | | 5/1987 |

OTHER PUBLICATIONS

Review: The IC2 series revealed. In: Radio & Electronics World, p. 58-63, Oct. 1981.
Larry Ledlow, The Kenwood TH-205AT Two-Meter Handheld. In: 73 Amateur Radio, p. 14, Dec. 1987.
Advertisment in Radio & Electronics World, Aug. 1988.
Robert Witmer, The UNI-8 Porta-Power Adapter. In: 73 Amateur Radio, Mar. 1990, p. 14-15.
Charles A. Geswein, Multi-Band Multi Mode Hand Held Radio. In: Proceedings of the 1996 Tactical Communications Conference, 1996, p. 335-339.
Japanese Article by Yukinori Kuwano, 1986, p. 63-70.
Dve Bush et al., Improved Vehicle operated auxiliary lead-acid battery charger, Aug. 1989.
Alfred H. Bellman et al., MANPACK: a new solution to a old problem. In: Signal, Apr. 1977, p. 6-10.
M. Pirson, A new vehicular and manpack HF/SSB radio. In: Philips Telecommunication Review, Aug. 1979, p. 188-195.
A. Kurtvits, 400 watt HF radio set for operation in extreme environments. In Communications Equipment and Systems, 1980, p. 255-259.
"Sony Do it Again" in: Radio & Electronics World, Jan. 1984, p. 23-24.
Advertisement in: Radio & Electronics World, Apr. 1984, p. 10-11.
G.N. Hobbs et al., "Scimitar H—combat net radio of the 80s", in: Communication & Broadcasting, Feb. 1985, p. 29-37.
Jason Meyers, "Getting the signal out: radio vendors broadcast quality, extension messages", in: Telephony, Mar. 31, 1997.
Paul Pinella, Gifts for grads, Dads, Moms, and marrieds, in: Saturday Evening Post, May-Jun. 1984.
Steve Ford, "A portable shortwave receiver roundup", in: QST, Aug. 1997.
WR World Receiver Satellit 700, by GRUNDIG.
Thomas Baier, The Great GRUNDIG Satelllit 700 catalog, Apr. 2002.

* cited by examiner

BATTERY CHARGING JOBSITE LUNCHBOX

This application is a continuation-in-part of application Ser. No. 10/685,280 filed Oct. 14, 2003, continuation-in-part of application Ser. No. 11/055,341, filed Feb. 10, 2005, and is also based upon provisional application Ser. No. 60/700,152 filed Jul. 18, 2005.

FIELD OF THE INVENTION

This invention generally relates to portable lunchbox equipment that is particularly useful at construction and other jobsites.

BACKGROUND OF THE INVENTION

Many construction and other workers frequently have to work at jobsites that are remotely located. Because such locations are often not conveniently located near eating establishments, coupled with the fact that lunch periods are often relatively short, it is commonplace for such workers to bring their lunches to the jobsite. While many workers are content to eat sandwiches and other unheated food, most would like to eat hot food at least some of the time. The ability to heat food at the jobsite greatly expands the choices for lunch. While many bring a thermos bottle for soup or coffee, heating capability enables these liquids to be heated to a higher temperature that may be more desirable to many workers.

Cordless power tools are frequently used at jobsites, whether convenient sources of power are readily available or not. These battery operated tools provide a portability and convenience advantages over corded tools, but the battery packs that power them become depleted and need to be recharged. While some workers bring a sufficient number of battery packs to last a complete day, there is generally at least temporary electrical service provided which may enable battery packs to be recharged on the jobsite.

Workers also like to take audio equipment such as portable radios to construction sites so that they can listen to music and other programs while they are working. It is well known that construction sites present a tough environment for such audio equipment which is prone to being damaged. These and other considerations demonstrate that a need exists for improved jobsite equipment.

SUMMARY OF THE INVENTION

A preferred embodiment of portable lunchbox equipment that is particularly useful at construction and other jobsites is disclosed which provides important desirable features and functionality comprising a housing, at least one charger for charging a removable battery pack, an audio unit for producing an audio signal, a heating unit, an active cooling unit, an insulated compartment, a cord and plug for connecting said apparatus to a source of AC power, and circuitry for selectively applying power to the audio unit, the charger, the cooling unit and the heating unit. The housing preferably has a rugged construction so that a user can use it as a chair to sit on while eating or resting.

An alternative embodiment includes an converter that allows the unit to be powered from a 12VDC or 24VDC automotive or similar source.

An alternative embodiment further comprises a video unit. Other embodiments comprise a set of wheels for easily transporting the equipment and AC and DC power outlets for powering other tools and equipment.

The preferred and alternative embodiments also preferably have a unique protective frame structure that is connected to the housing of the unit.

DETAILED DESCRIPTION OF THE PREFERRED AND ALTERNATIVE EMBODIMENTS

Figure 1:
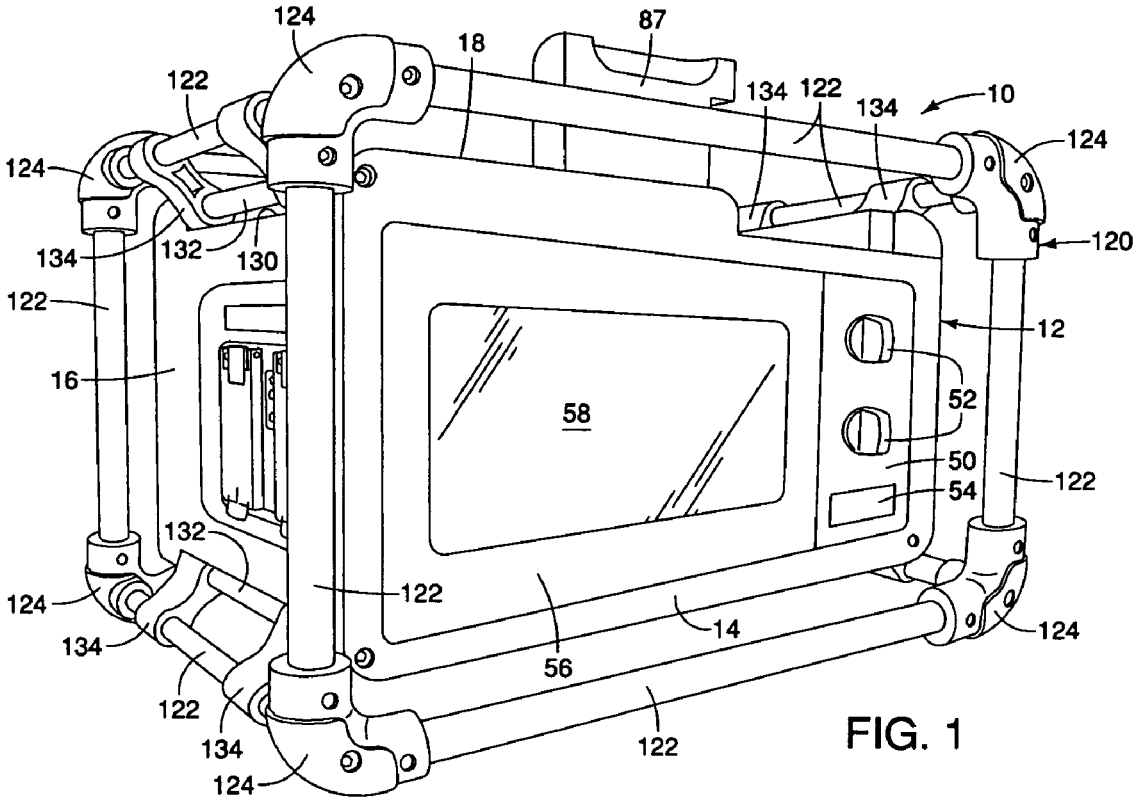
FIG. 1 is a perspective view of the front and left sides of the preferred embodiment of the present invention.

A preferred embodiment of the battery charging jobsite lunchbox is shown in the drawings and is indicated generally at 10, which has a housing, indicated generally at 12 in the form of a cuboid that includes a front face or wall 14, a left side face or wall 16, a top surface 18, a rear wall 20 and a right side face or wall 22. The housing 12 is preferably made of a tough plastic or other molded material, and may be comprised of a few or several parts that structurally fit together in a rugged strong unit. For example, the front and back walls 14 and 20 may be generally flat unitary pieces which are connected together to one or more molded or otherwise formed front, top, bottom and rear walls that may be formed as one, two, or more components that are connected together.

Figure 2:
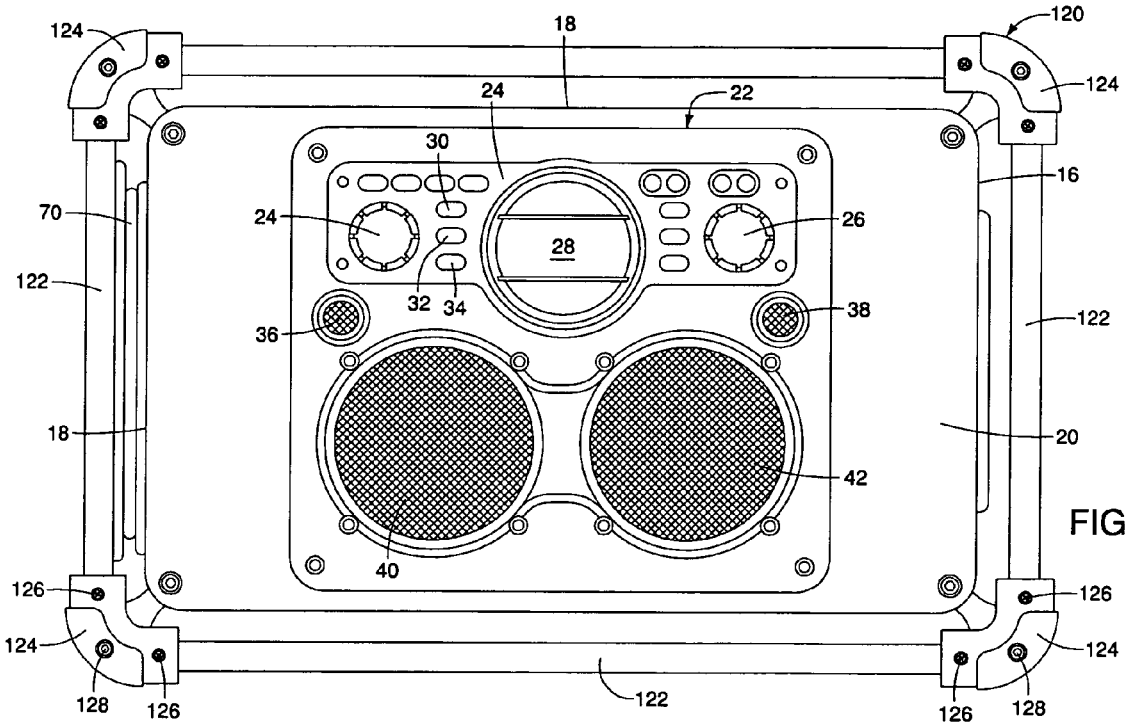
FIG. 2 is a plan view of the back side of the preferred embodiment shown in FIG. 1.

The preferred embodiment has an audio unit, indicated generally at 22, which is located in the rear face 20 of the unit. As best shown in FIGS. 1 and 2, the audio unit comprises a radio that has a control panel 24 with a volume control 24, a tuning control 26, a display 28 for displaying the station identification as well as the current time. There are time adjust buttons 30, 32 and 34 with the button 32 controlling the hours, setting and the button 34 controlling the minutes setting. A CD player or a digital media player may also be provided as part of the unit 22. Speakers 36, 38, 40 and 42 are also provided and are located below the control panel 24. The unit may also have remote speakers if desired.

Figure 4:
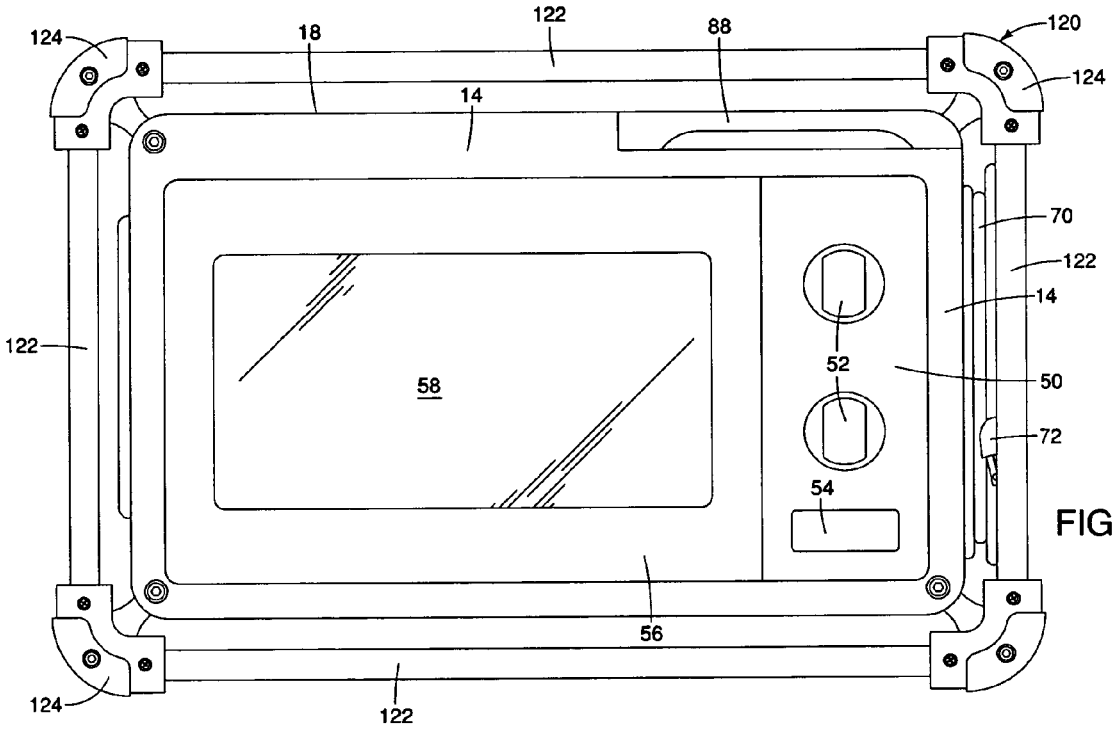
FIG. 4 is a plan view of the front side of the preferred embodiment shown in FIG. 1.

As is shown in FIGS. 1 and 4, a microwave unit 50 is provided for heating and/or cooking food, and has appropriate control knobs 52, a display 54 and a hinged door 56 with a see through glass panel 58 as is common.

Figure 6:
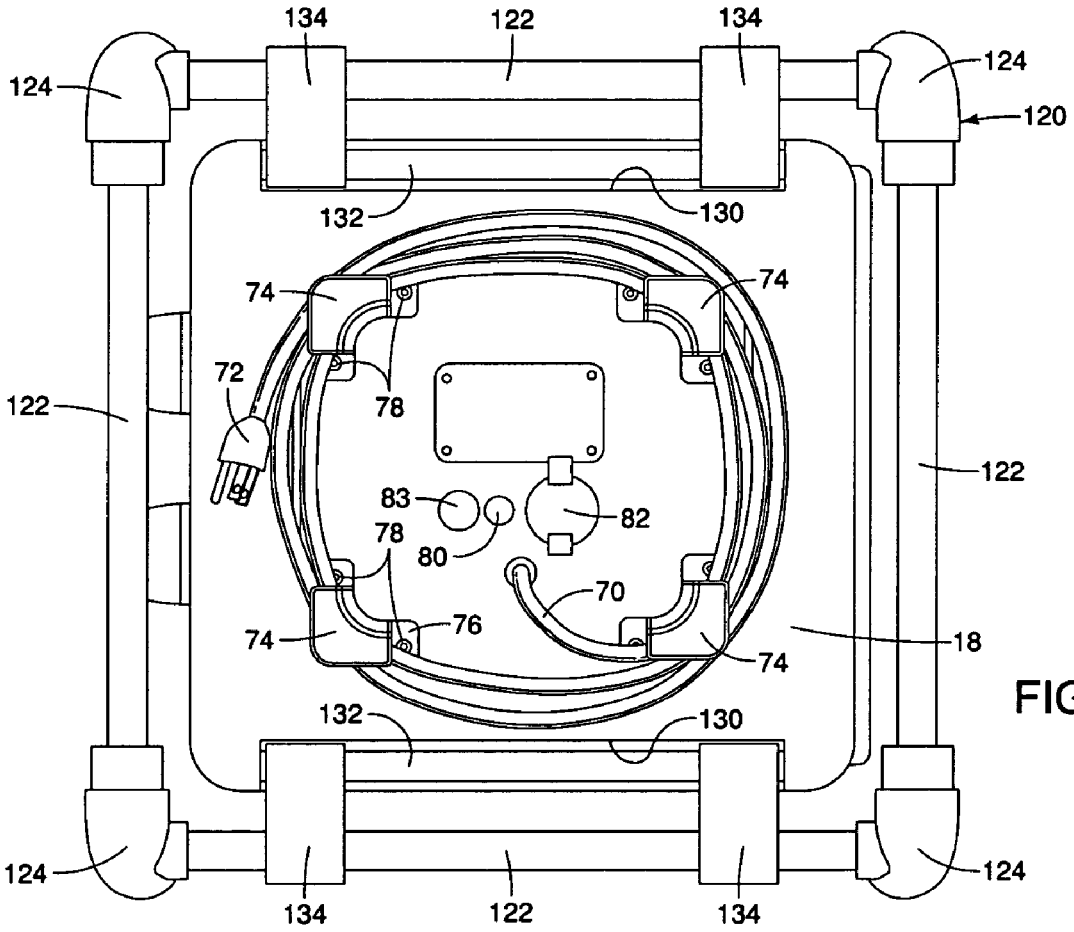
FIG. 6 is a plan view of the right side of the preferred embodiment shown in FIG. 1.

The unit can be connected or plugged into a source of AC power using a cord 70 having a 3-prong plug 72 as best shown in FIG. 6. The unit has a cord wrap structure comprising four outwardly extending flanges 74 that are arranged in a square around which the cord can be wrapped for storage. The flanges each have a base portion 76 for mounting to the sidewall 14 and are connected thereto by screws 78 or the like.

Figure 9:
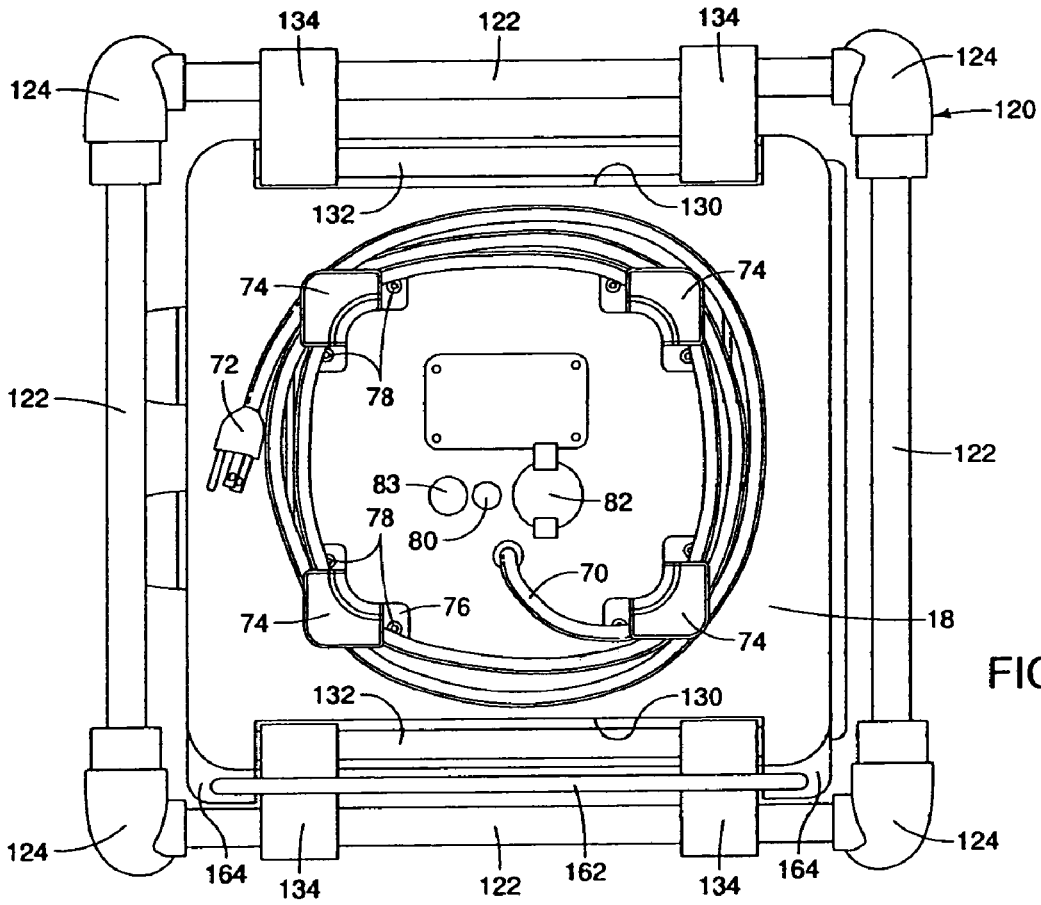
FIG. 9 is a plan view similar to FIG. 6 of the alternative embodiment shown in FIG. 8, particularly illustrating the lunchbox having a retractable handle.

It should also be understood that the flanges 74 may be integrally formed in the sidewall 14 if desired. A fuse 80 for the circuitry to be described is accessible on the left side wall 14 as is a DC receptacle or socket 82 which is protected from the elements by a removable flexible plug that is preferably made of rubber or like material which can be inserted into the receptacle opening. A 2-channel stereo mini plug receptacle 83 is located adjacent the fuse 22 which can be used to input an auxiliary audio source that can be played through the unit. The receptacle 83 is therefore connected to the audio unit 22 as shown in FIG. 9. The presence of an auxiliary audio source in the receptacle 83 can be detected and thereby be selected as the source for playing, or a switch can be provided for selecting the integral audio unit or the unit connected to the auxiliary receptacle.

Figure 5:
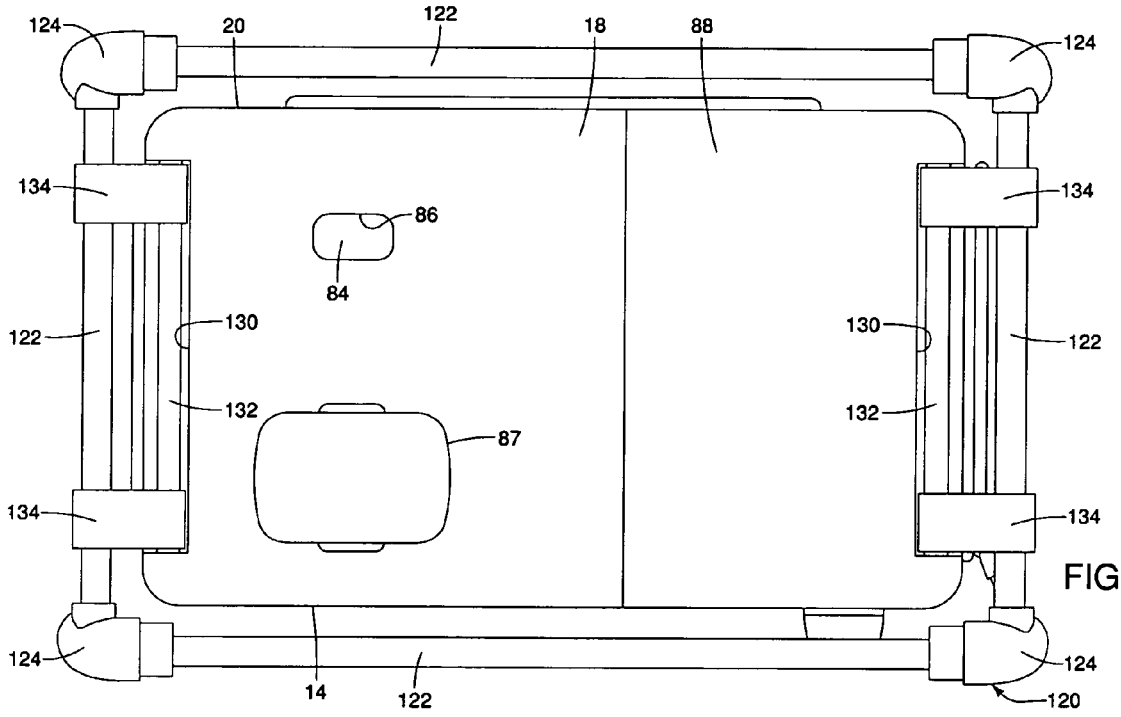
FIG. 5 is a top view of the preferred embodiment shown in FIG. 1.
Figure 7:
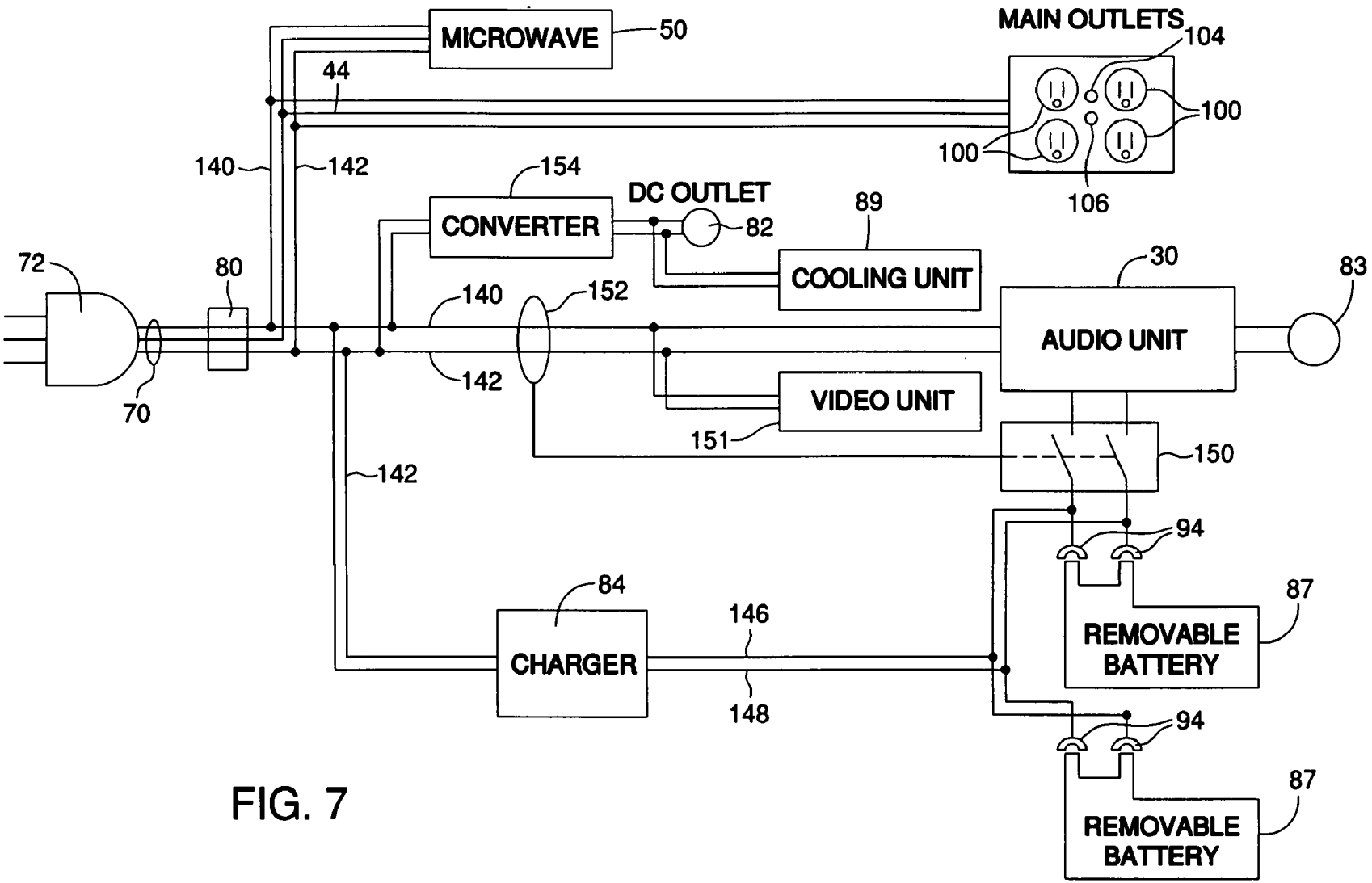
FIG. 7 is an electrical schematic diagram of the preferred embodiment and including a converter of an alternative embodiment.

The unit can have a single charger or two separate chargers 84 for charging two of the same type or different types of batteries located in the top surface 18 of the housing 12 which are accessible through apertures 86, one of which is shown in FIG. 5, with the other having a battery pack 87 inserted into the charger in position to be charged. A door 88 is provided on the opposite end of the top surface of the housing which at its upper end which engages a complimentary surface to hold the door shut, but which can be readily opened by a user without difficulty. A hinge on the lower end of the door near the back wall 20 enables the door to be opened to reveal an insulated chamber for holding food or other material. This chamber uses an active cooling unit 89 that is driven by DC voltage supplied by an AC to DC converter 154 as shown in FIG. 7.

Figure 3:
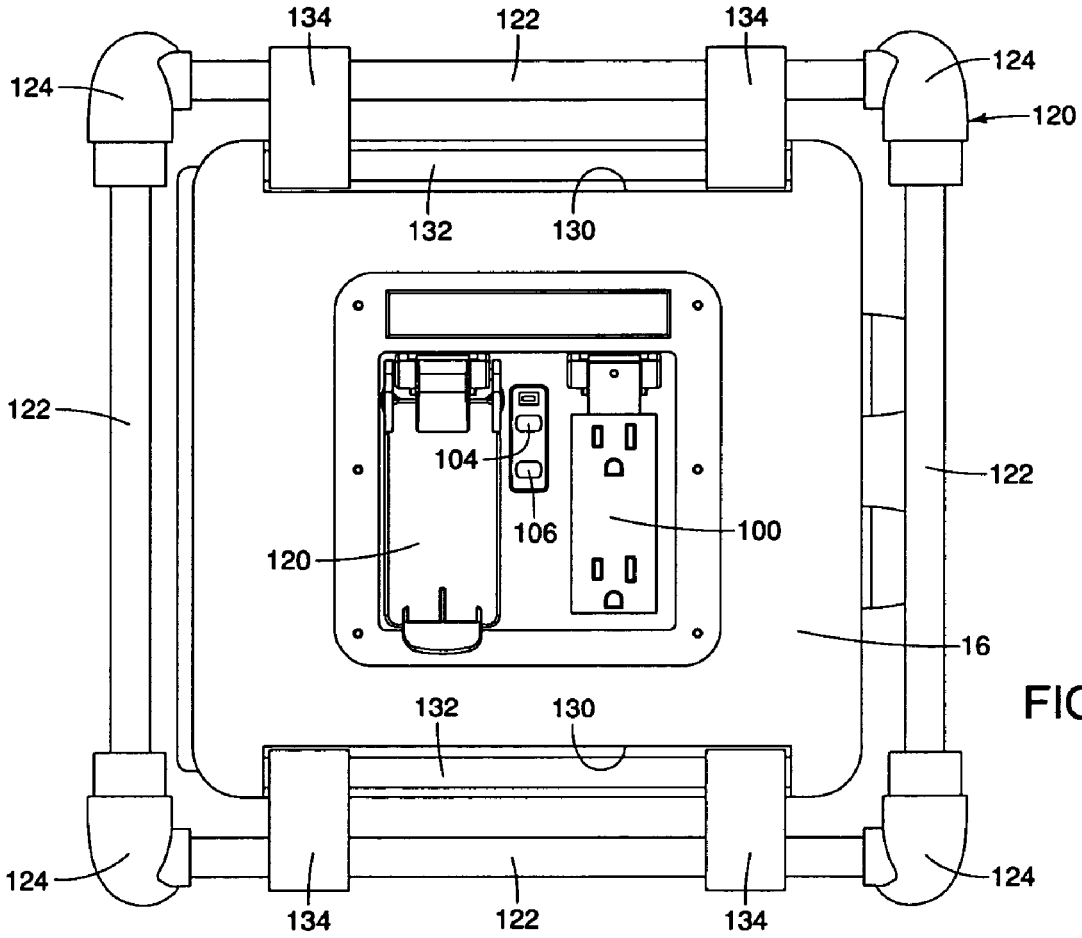
FIG. 3 is a plan view of the left side of the preferred embodiment shown in FIG. 1.

On the left side wall 16 and referring to FIG. 3, a pair of duplex AC outlets 100 are located beneath doors 102 (only one of which is shown) that are hinged at the top of the outlet pair. While they may be standard duplex receptacles, it is preferred that they be ground fault circuit interrupters to provide an extra measure of safety for the users, particularly given the fact that the unit may be subjected to harsh weather conditions. As is standard for ground fault circuit interrupters, a reset button 104 and test button 106 are provided. Due to the nature of the product, the entire unit may have GFCI protection on the main power cord 72.

As is apparent from the drawings, the unit has a frame structure, indicated generally at 120, which is shown in all of the drawings. The frame structure 120 is larger than the housing 12 in every direction and thereby provides a protective structure for the housing itself, as well as the components that are present on each of the front, rear and side faces of the housing. The frame structure has a number of elongated cylindrical rods 122 that are preferably made of hollow aluminum. The rods extend in spaced relation to the interface of each two walls as is apparent from the drawings. At the intersection of three walls which occurs at each of the eight corners of the frame structure 120, three cylindrical rods 122 are terminated in a three way connector 124 that is preferably made of strong, hard plastic or plastic-like material that is capable of withstanding abusive treatment without incurring damage. As best shown in FIGS. 2 and 4, each of the connectors has a pair of set screws 126 that fit within openings in the connector 124 and which engage the side of a cylindrical rod 122 in either the horizontal or vertical direction as shown in these drawings and which has a hex head screw 128 that is positioned to engage the rod 122 oriented in the direction transverse to the horizontal and vertical direction as shown in FIGS. 2 and 4. The set screw 128 may engage the inside diameter of the hollow rod 122 or it may engage a plug or other member that is inserted into each end of such transverse to the cylindrical rods 122, such that a secure attachment of the connector to the rod is achieved. With regard to the screws 126, they may merely tighten against the outer surface of the rods in which they contact, or they may be screwed into the side of the rods.

As best shown in FIGS. 1, 3 and 5, the housing has an elongated recess 130 located at the corner of the top and sides of the housing as well as the bottom and sides of the housing. A shorter cylindrical rod preferably having the same construction and outside diameter 132 fits within each recess and is secured at opposite ends by fitting into correspondingly sized openings in the housing. The frame structure 120 is connected to these rods 132 by connecting links 134 which have openings in opposite ends through which rods 122 and 132 may pass. There is a link 134 at the end of each recess 122, meaning that a total of eight of them are utilized to secure the frame structure 120 to the housing 12. The links 134 are preferably made of the same material as the connectors 124 so that they will not be easily damaged by the typically rough treatment that the unit may receive on a construction site.

With regard to the electrical schematic of the unit embodying the present invention and referring to FIG. 7, the audio unit 22 is shown being connected to the cord 70 via fuse 80 and lines 140 and 142. A ground 144 also extends from the outlets 100 to the plug 72. Lines 140 and 142 also extend to the outlets 100 as well as to the charger 84, with the charger 84 having output lines 146 and 148 that extend to contacts 94 located below the apertures 86 into which a stem portion of a removable battery pack 87 can be inserted. Lines 146 and 148 of at least the upper illustrated charger 84 also extend to a relay 150 that is controlled by a relay coil 152 which senses whether current is flowing in the lines 140 and 142. The relay 150 is a normally closed relay which is opened when the plug 72 is connected to a source of AC power which means that the audio unit is being driven by the AC power source. It should be understood that the audio unit may actually run on DC voltage and that the audio unit may have an internal voltage converter as part of its construction. An alternative embodiment may include a video unit 151 if desired, which can be a television set or a DVD player. As shown in FIG. 7, the video unit 151 is shown to be powered by the AC lines 140, 142, but it should be understood that the unit may have an internal AC to DC convertor and may be DC powered.

Another converter 154 may be provided to power the DC outlet 82. When the plug 72 is connected to an AC power source, the charger 84 is operational to charge the removable battery if it is placed in the receptacle 94 and the outlets 100 are available to supply power to other tools, lights or the like, as is the DC outlet 82 that is connected to the output of the converter 154. Also, if the video unit 151 is DC powered, it can be connected to the output of converter 154 if it does not have an internal AC to DC converter.

If the plug 72 is removed from AC power, the relay 150 will be close circuited so that the removable battery will be connected to the audio unit and can power the audio unit. It should be understood that the charger is incapable of powering the audio unit when the relay is open circuited as shown in the drawing and is incapable of powering the audio unit 22 when AC power is not applied to the circuit inasmuch as the charger 84 does not have a resident battery or other power source other than AC power through the lines 140 and 142.

An additional alternative embodiment can include an converter 154 having a receptacle 82 for connection to a 12 or 24 VDC source such as a motor vehicle or other source, with the converter 154 being connected to a relay 150 that is controlled by coil 152. If there is no source of power applied to the cord 70, the relay 150 is closed and the AC output from converter 154 can power the circuitry.

Figure 8:
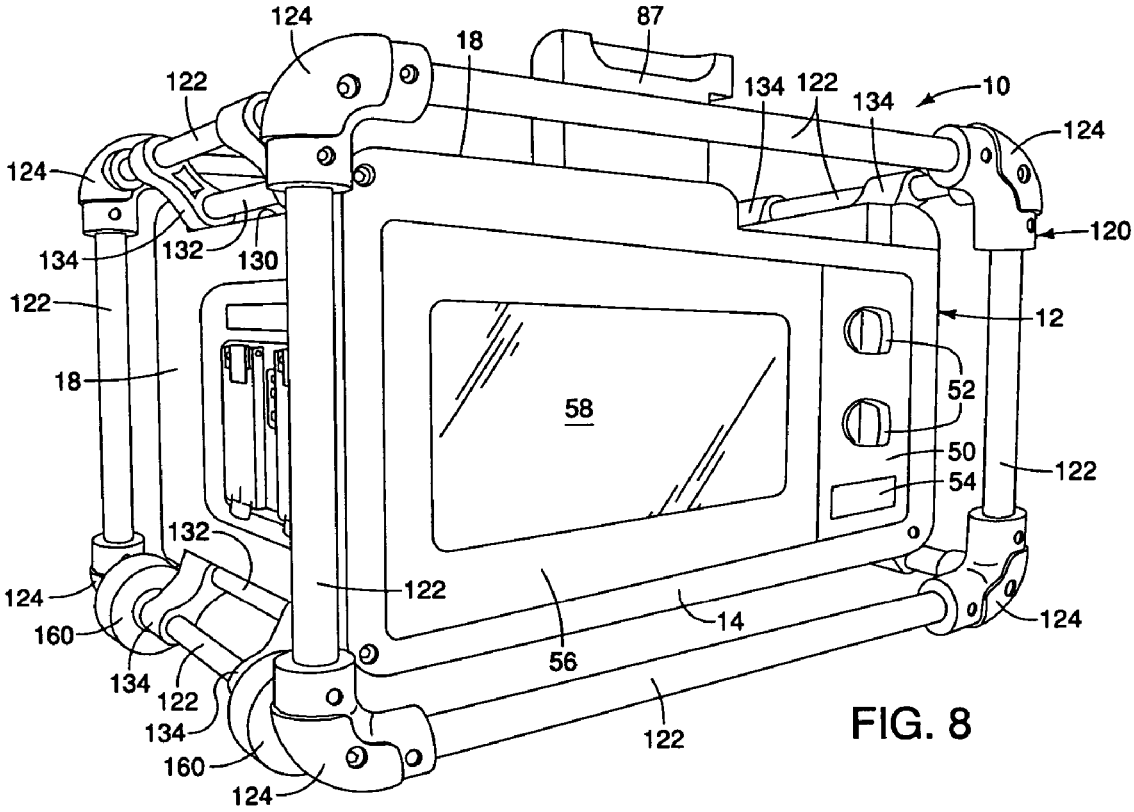
FIG. 8 is a perspective view similar to FIG. 1 of an alternative embodiment, particularly illustrating a battery charging jobsite lunchbox having wheels.

Another alternative embodiment is illustrated in FIGS. 8 and 9, which includes a pair of wheels 160 located at one end portion of the lunch box 10 and a retractable handle 162 slideably mounted in brackets 164 attached to the housing 12. This arrangement provides convenient movement of the lunch box 10, which can be relatively heavy because of the substantial functionality that is provided by the lunch box. It should also be understood that wheels may be directly attached to the housing rather than being mounted on cylindrical rods 122 as shown. It should be appreciated that while most of the rods are hollow cylindrical rods, the rods 122 on which the wheels 160 are mounted may be solid steel or of a construction that can withstand the loading provided by the lunchbox. Alternatively, the lunchbox may have three or four preferably pivotable casters mounted to the bottom thereof and a flexible strap suitably attached to the lunchbox would enable a user to pull the lunchbox along at a jobsite The present invention can have other media sources and functionality as shown and described in the patent application entitled PORTABLE BATTERY CHARGING AND AUDIO UNIT, Ser. No. 11/055,341, filed Feb. 10, 2005, which is specifically incorporated by reference herein.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention.

Various features of the invention are set forth in the following claims.

What is claimed is:

1. An apparatus comprising:

a housing having a number of walls, a top and a bottom;

a charger located in said housing for charging a removable battery pack of the type which is used to power rechargeable hand tools and other tools;

a charging receptacle operatively connected to said charger and being capable of receiving at least one removable battery pack having a positive and a negative connection to be charged by said charger;

an audio unit for producing an audio signal located in said housing;

a microwave oven heating unit having a first compartment in which food can be placed and heated;

an active cooling unit;

a user accessible insulated second compartment in which said cooling unit is operatively connected to cool the same;

a cord and plug for connecting said apparatus to an AC power source, and circuitry for connecting said AC source to said charger and said audio unit, said circuitry including a converter to provide DC power to power said cooling unit, said circuitry selectively applying power to the audio unit from one of said AC source and a removable battery pack, said circuitry further comprising:

a relay connected between a battery pack located in said charging receptacle and said audio unit;

a relay coil connected between said cord and said audio unit, said coil monitoring the presence of AC power being applied to said audio unit and causing said relay to open circuit both said positive and negative connections to said battery to thereby electrically isolate said audio unit from said battery when AC power is applied to said audio unit and close circuit when AC power is not applied to said audio unit, thereby enabling said battery pack to power said audio unit when AC power is not applied thereto.

2. An apparatus as defined in claim 1 further including an AC to DC converter connected in said circuitry and at least one DC power receptacle connected to said converter.

3. An apparatus as defined in claim 2 further including a ground fault circuit interrupter connected in said circuitry between said at least one AC power receptacle and said cord.

4. An apparatus as defined in claim 1 wherein said audio unit comprises a radio.

5. An apparatus as defined in claim 4 wherein said audio unit further comprises a CD player.

6. An apparatus as defined in claim 1 further comprising a video unit.

7. An apparatus as defined in claim 6 wherein said video unit comprises a TV set.

8. An apparatus as defined in claim 6 wherein said video unit comprises a DVD player.

9. An apparatus as defined in claim 1 wherein said user accessible insulated compartment has a hinged door on the top of said housing for accessing said compartment.

10. An apparatus as defined in claim 1 wherein said audio unit has operating controls and displays located in a front wall of said housing.

11. An apparatus as defined in claim 1 further comprising a set of wheels attached to said housing to facilitate easy transport of said apparatus.

12. An audio power unit for providing an audio output and for charging removable battery packs, said unit comprising:

a housing having front, rear, left and right side walls, a top and a bottom;

a charger including at least one charging receptacle located in said housing for charging one or more of the removable battery packs each having a positive and a negative connection;

a microwave oven heating unit having a first compartment in which food can be placed and heated;

an active cooling unit driven by a DC voltage;

a user accessible insulated second compartment in which said active cooling unit is operatively connected to cool the same;

an audio unit for producing an audio output located in said housing;

a cord and plug for connecting said apparatus to a source of AC power a circuit for connecting said cord to said charger and said audio unit, whereby AC power is applied to said audio unit to power the same and AC power is also applied to said charger, said circuit comprising a relay connected between a battery pack located in said charging receptacle and said audio unit, and a relay coil connected between said cord and said audio unit, said coil monitoring the presence of AC power being applied to said audio unit and causing said relay to open circuit both said positive and negative connections to said battery to thereby electrically isolate said audio unit from said battery pack when AC power is applied to said audio unit and connect said battery pack to power said audio unit when AC power is not applied to said audio unit, said circuitry including a converter to provide DC power to power said active cooling unit when AC power is applied to said audio unit.

13. An apparatus comprising:

a housing having a number of walls, a top and a bottom;

a charger located in said housing for charging a removable battery pack of the type which is used to power rechargeable hand tools and other tools;

a charging receptacle operatively connected to said charger and being capable of receiving at least one removable battery pack having a positive and a negative connection to be charged by said charger;

an audio unit for producing an audio signal located in said housing;

a microwave oven heating unit;

a user accessible insulated compartment;

a cord and plug for connecting said apparatus to an AC power source, and circuitry for connecting said AC source to power said heating unit and said charger and for selectively applying power to the audio unit from one of said AC source and a removable battery pack, said circuit comprising a relay connected between a battery pack located in said charging receptacle and said audio unit, and a relay coil connected between said cord and said audio unit, said coil monitoring the presence of AC power being applied to said audio unit and causing said relay to open circuit both said positive and negative connections to said battery to thereby electrically isolate said audio unit from said battery pack when AC power is applied to said audio unit and connect said battery pack to power said audio unit when AC power is not applied to said audio unit.

14. An apparatus as defined in claim 13 further comprising a set of wheels attached to said housing to facilitate easy transport of said apparatus.

15. An apparatus as defined in claim 14 wherein said set of wheels are located at one end portion thereof, said apparatus further comprising a retractable handle located at an end portion of said housing opposite said set of wheels.

* * * * *

UNITED STATES PATENT AND TRADEMARK OFFICE

CERTIFICATE OF CORRECTION

PATENT NO. : 7,835,534 B2
APPLICATION NO. : 11/488330
DATED : November 16, 2010
INVENTOR(S) : Cole, Jr. et al.

It is certified that error appears in the above-identified patent and that said Letters Patent is hereby corrected as shown below:

On the title page of the Patent:

FOREIGN PATENT DOCUMENTS
(Continued on Page 3 - first column, 4th item under heading)
Delete "DE G5342534 3/1974" and replace
it with --DE G7342534 3/1974--

OTHER PUBLICATIONS
(Continued on Page 3 - second column, 7th item under heading)
Delete "Dve Bush et al.," and replace
it with --Dave Bush et al.,--

In the Claims:

| | |
|---|---|
| Col. 6, Line 43 | After "AC power" insert a semi-colon --;-- |
| Claim 12 | and insert a paragraph before "a circuit for connecting" |

Signed and Sealed this
Twenty-eighth Day of June, 2011

David J. Kappos

David J. Kappos
*Director of the United States Patent and Trademark Office*